US011844401B2

(12) United States Patent
Swigart et al.

(10) Patent No.: US 11,844,401 B2
(45) Date of Patent: Dec. 19, 2023

(54) ARTICLE OF FOOTWEAR WITH CLOSURE SYSTEM

(71) Applicant: Acushnet Company, Fairhaven, MA (US)

(72) Inventors: John F. Swigart, Portland, OR (US); Paul O. Teeter, Pembroke, MA (US)

(73) Assignee: Acushnet Company, Fairhaven, MA (US)

( * ) Notice: Subject to any disclaimer, the term of this patent is extended or adjusted under 35 U.S.C. 154(b) by 24 days.

(21) Appl. No.: 17/517,274

(22) Filed: Nov. 2, 2021

(65) Prior Publication Data

US 2022/0151342 A1 May 19, 2022

Related U.S. Application Data

(60) Provisional application No. 63/115,162, filed on Nov. 18, 2020.

(51) Int. Cl.

| | |
|---|---|
| ***A43C 11/16*** | (2006.01) |
| ***A43C 7/02*** | (2006.01) |
| ***A43C 1/00*** | (2006.01) |
| ***A43C 11/00*** | (2006.01) |

(52) U.S. Cl.

CPC ..... *A43C 11/165* (2013.01); *A43C 1/00* (2013.01); *A43C 7/02* (2013.01); *A43C 11/008* (2013.01)

(58) Field of Classification Search

CPC . A41C 11/165; A41C 11/008; A41C 11/1493; A41C 1/00; A41C 1/02; A41C 1/006; A41C 1/04; A43C 7/02; A43C 7/08; A43C 9/00

See application file for complete search history.

(56) References Cited

U.S. PATENT DOCUMENTS

| | | | | | |
|---|---|---|---|---|---|
| 4,079,527 | A * | 3/1978 | Antonious | A43C 11/1493 | 36/51 |
| 4,547,981 | A * | 10/1985 | Thais | A43C 11/1493 | 36/114 |
| 5,317,820 | A * | 6/1994 | Bell | A43B 7/20 | 36/114 |
| 5,381,609 | A * | 1/1995 | Hieblinger | A43C 11/00 | 36/50.1 |
| 5,408,761 | A * | 4/1995 | Gazzano | A43C 11/008 | 36/31 |
| 5,651,197 | A * | 7/1997 | James | A43C 11/16 | 36/88 |
| 5,659,982 | A * | 8/1997 | Muraoka | A43B 5/14 | 36/131 |
| 5,692,319 | A * | 12/1997 | Parker | A43C 1/00 | 36/114 |

(Continued)

FOREIGN PATENT DOCUMENTS

| | | |
|---|---|---|
| JP | 3942690 | 7/2007 |
| KR | 10-2013-0107924 | 10/2013 |
| KR | 10-1955844 | 3/2019 |

*Primary Examiner* — Bao-Thieu L Nguyen

(57) ABSTRACT

An article of footwear has a flexible upper, a sole, a bite line, a heel region, a forefoot region, a medial side, a lateral side, and a flap. The article of footwear is secured using a closure system that may be tightened and loosened. The flap is coupled to the article of footwear proximate the bite line and is configured to interact with the closure system. The closure system secures the flap to the upper when the closure system is tightened.

18 Claims, 11 Drawing Sheets

(56) References Cited

U.S. PATENT DOCUMENTS 5,692,320 A * 12/1997 Nichols ..... A43C 1/02 36/51
5,791,021 A * 8/1998 James ..... A43C 11/1406 24/712.2
6,128,835 A * 10/2000 Ritter ..... A43C 1/00 36/114
7,343,701 B2 3/2008 Pare et al.
8,857,077 B2 * 10/2014 Kahatsu ..... A43C 1/04 36/91
8,869,435 B2 10/2014 Hatfield et al.
8,991,074 B2 3/2015 Ivester et al.
9,220,318 B2 * 12/2015 James ..... A43B 11/00
9,375,052 B2 6/2016 Krueger
10,299,540 B2 5/2019 Bishop et al.
10,299,541 B2 5/2019 Bishop et al.
2008/0110048 A1 5/2008 Dua et al.
2008/0163515 A1 * 7/2008 Rackiewicz ..... A43B 1/0045 36/7.1 R
2011/0239486 A1 * 10/2011 Berger ..... A43B 7/1495 36/25 R
2012/0079741 A1 * 4/2012 Kohatsu ..... A43B 23/0245 36/50.1
2013/0138028 A1 * 5/2013 Gerber ..... A43B 3/242 602/27
2016/0157561 A1 * 6/2016 Schum ..... A43B 3/34 242/390
2016/0206045 A1 * 7/2016 Meir ..... A43B 23/042
2016/0366982 A1 * 12/2016 Chaney ..... A43C 15/061
2017/0035151 A1 * 2/2017 Peyton ..... A43B 3/26
2017/0065027 A1 * 3/2017 Hyde ..... A43C 5/00
2019/0069626 A1 * 3/2019 Kuefler ..... A43B 23/0245
2019/0313740 A1 10/2019 Workman et al.
2019/0313742 A1 * 10/2019 Bell ..... A43C 5/00
2020/0205522 A1 7/2020 Dombrow et al.
2020/0229543 A1 7/2020 Houng et al.
2020/0323309 A1 * 10/2020 Hanat ..... A43B 13/14
2021/0112922 A1 * 4/2021 Bock ..... A43C 1/006
2021/0368946 A1 * 12/2021 Aoki ..... A43C 1/003
2022/0031024 A1 * 2/2022 Cook ..... A43C 11/008

* cited by examiner

ARTICLE OF FOOTWEAR WITH CLOSURE SYSTEM

CROSS-REFERENCE TO RELATED APPLICATIONS

This application claims the benefit of U.S. Provisional Application No. 63/115,162, filed Nov. 18, 2020, the entire disclosure of which is incorporated by reference herein.

FIELD OF THE DISCLOSURE

The disclosure relates generally to the field of footwear. More specifically, the disclosure relates to the field of footwear with a closure system and a flap for stability.

SUMMARY

The following presents a simplified summary of the disclosure in order to provide a basic understanding of some aspects of the disclosure. This summary is not an extensive overview of the disclosure. It is not intended to identify critical elements of the disclosure or to delineate the scope of the disclosure. Its sole purpose is to present some concepts of the disclosure in a simplified form as a prelude to the more detailed description that is presented elsewhere.

In one embodiment, an article of footwear may comprise a flexible upper, a sole having an outsole and a midsole, a bite line, a heel region, and a forefoot region. The article of footwear may have a medial side extending from the forefoot region to the heel region. The article of footwear may have a lateral side extending from the forefoot region to the heel region, the lateral side being opposite to and generally parallel the medial side. The article of footwear may further have a closure system for securing the article of footwear which may be tightened and loosened. The article of footwear may further comprise at least one flap coupled to the article of footwear proximate the bite line. The closure system may be configured to interact with the flap, and, when tightened, the closure system may be configured to secure the flap to the upper.

In another embodiment, an article of footwear may comprise a flexible upper, a sole having an outsole and a midsole, a bite line, a heel region, and a forefoot region. The article of footwear may have a medial side extending from the forefoot region to the heel region. The article of footwear may have a lateral side extending from the forefoot region to the heel region, the lateral side being opposite to and generally parallel the medial side. The article of footwear may further comprise a closure system having laces and lace guides, wherein the laces are threaded through at least one lace guide located proximate the bite line. The article of footwear may further comprise at least one flap coupled to the article of footwear proximate the bite line.

In yet another embodiment, an article of footwear may comprise a flexible upper, a sole having an outsole and a midsole, a bite line, a heel region, and a forefoot region. The article of footwear may have a medial side extending from the forefoot region to the heel region. The article of footwear may have a lateral side extending from the forefoot region to the heel region, the lateral side being opposite to and generally parallel the medial side. The article of footwear may further comprise an adjustable closure system and a flap. The flap may have a forefoot end, a heel end, and an uppermost point. The flap may be coupled to the article of footwear proximate the bite line. The flap may be variable between an engaged position and a relaxed position. In the engaged position, the flap may provide lateral support to a midfoot region of the article of footwear.

BRIEF DESCRIPTION OF THE SEVERAL VIEWS OF THE DRAWINGS

Illustrative embodiments of the present disclosure are described in detail below with reference to the attached drawing figures and wherein.

DETAILED DESCRIPTION

Figure 1:
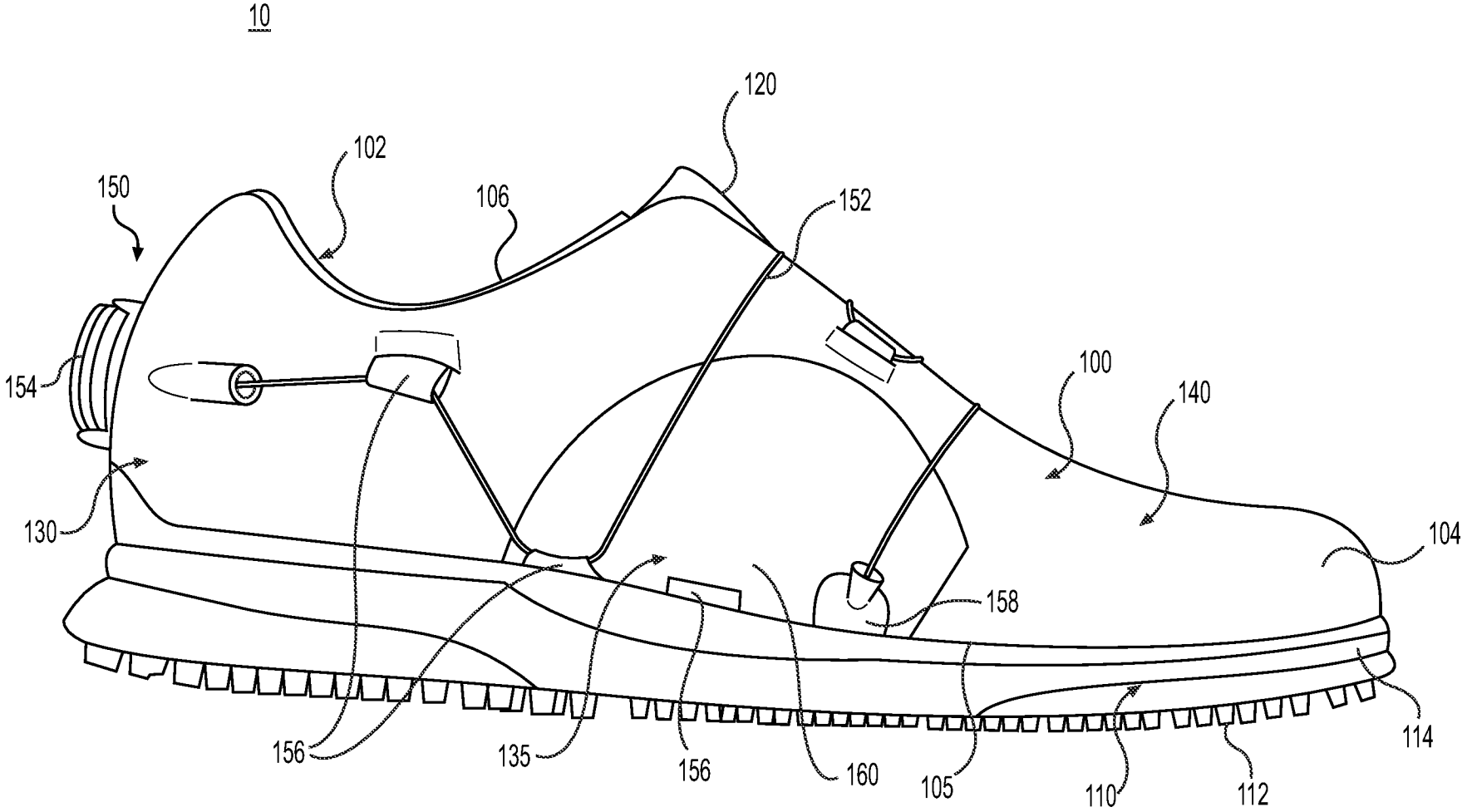
FIG. 1 is a side view of an article of footwear according to one embodiment.
Figure 2:
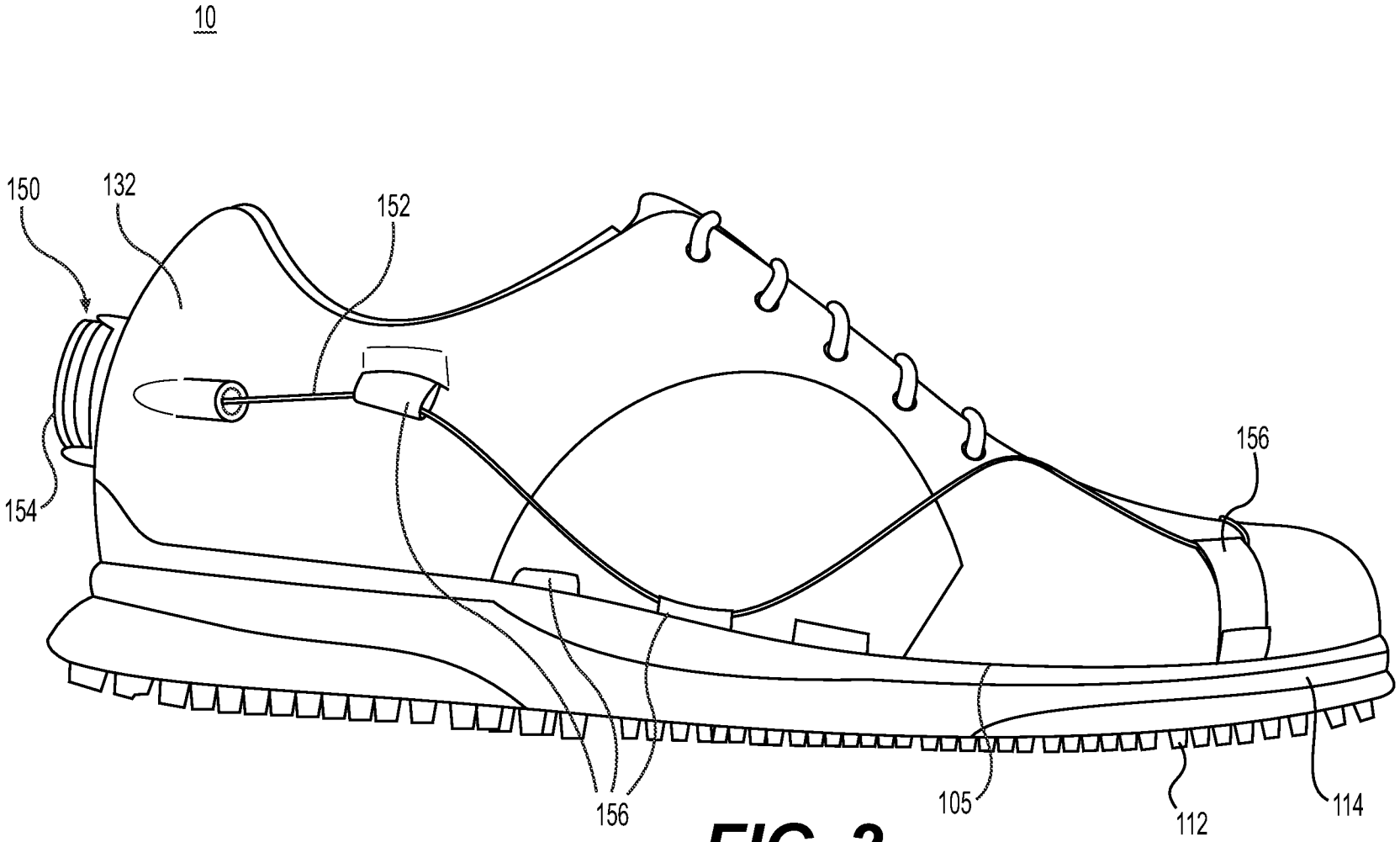
FIG. 2 is a side view of the article of footwear of FIG. 1 according to another embodiment.
Figure 3:
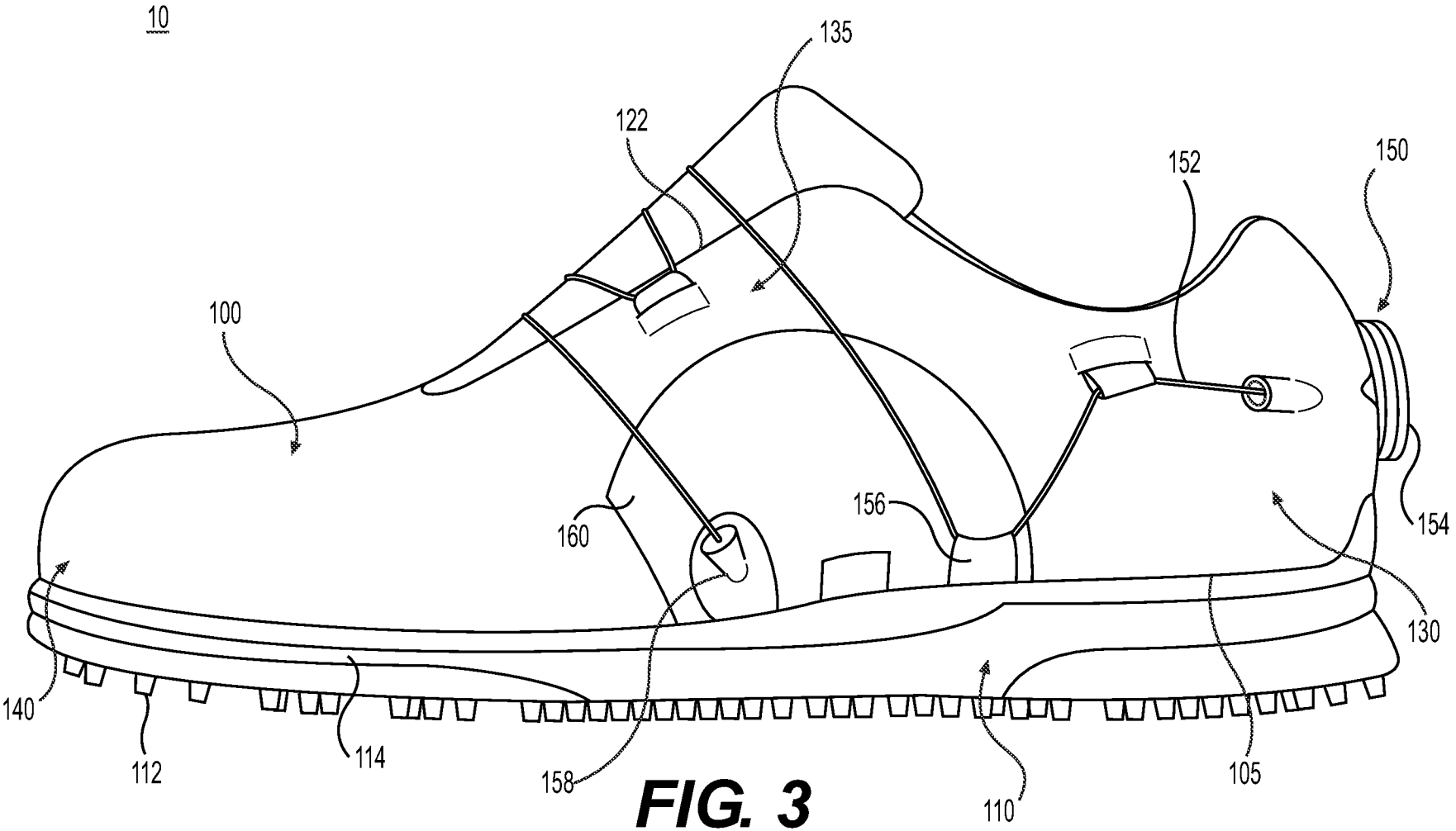
FIG. 3 is a side view of the article of footwear of FIG. 1 according to another embodiment.
Figure 4:
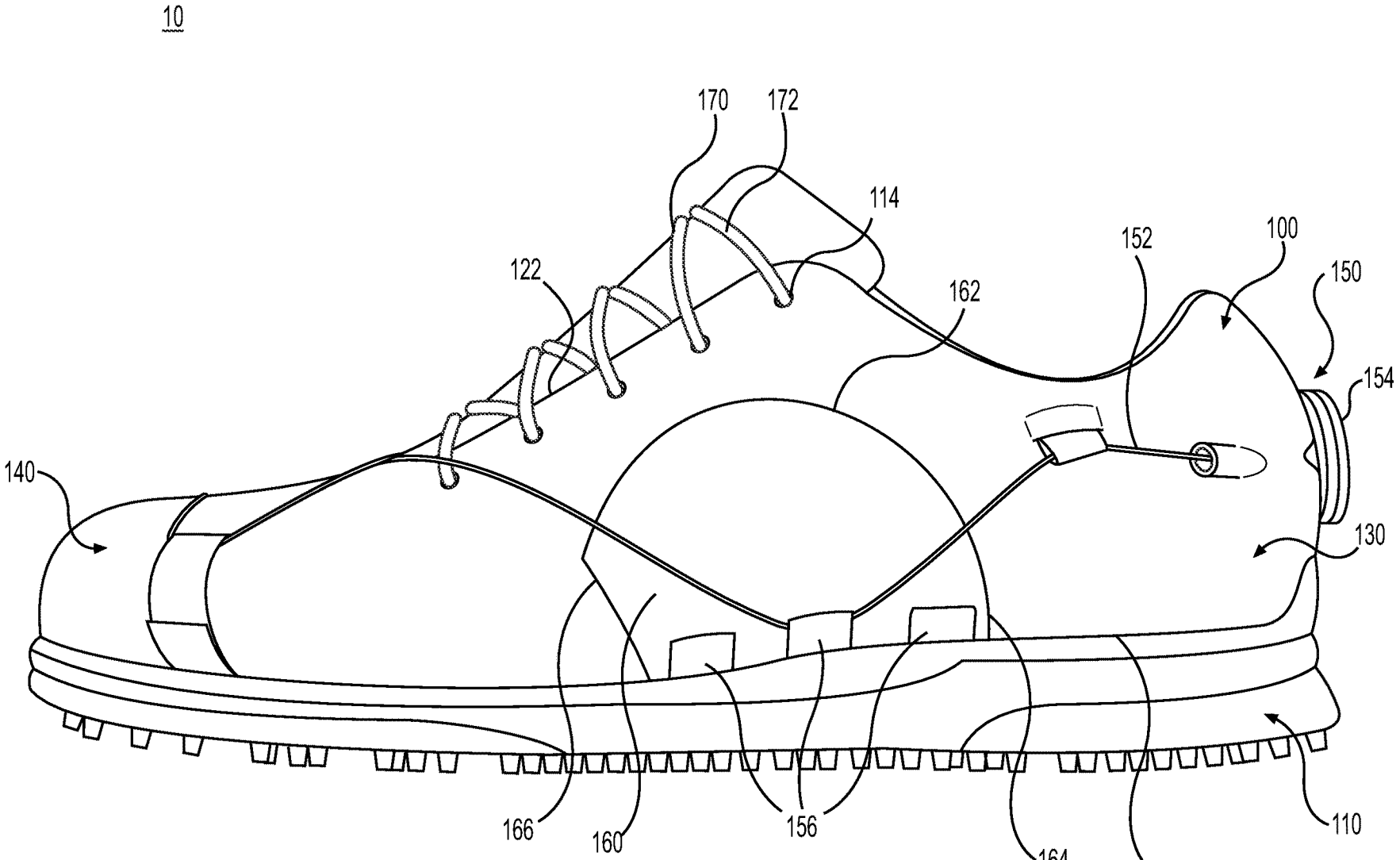
FIG. 4 is a side view of the article of footwear of FIG. 1 according to another embodiment.

The present invention now will be described more fully in reference to the accompanying figures, in which embodiments of the invention are shown. However, this invention should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

The terminology used herein is for the purpose of describing particular embodiments only and is not intended to be limiting of the invention. As used herein, the singular forms "a," "an," and "the" are intended to include the plural forms as well, unless the context clearly indicates otherwise.

It will be understood that when an element is referred to as being "attached," "coupled" or "connected" to another element, it can be directly attached, coupled or connected to the other element or intervening elements may also be present. In contrast, when an element is referred to as being "directly attached," directly coupled" or "directly connected" to another element, there are no intervening elements present.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner.

These and other objects and/or aspects of the present invention are explained in detail in the specification set forth below.

An article of footwear 10 is shown in FIGS. 1-10 and includes a flexible upper 100 and a sole 110. As shown in FIG. 1, the article of footwear 10 may further include a heel region 130, a forefoot region 140, a closure system 150, and a flap 160.

The heel region 130 may generally correspond with the rear portions of a foot, namely, the area surrounding and below the Achilles tendon, the posterior of the heel, and the talus and calcaneus bones. A forefoot region 140 may generally correspond with a front of a foot, namely, the toes and metatarsal, phalange, and sesamoid bones. A midfoot region 135 may generally correspond with a middle of the foot, namely, the arch and the navicular, cuboid, and cuneiform bones. It is understood that the heel region 130, midfoot region 135, and forefoot region 140 are intended to represent general areas of footwear and not demarcate precise areas.

The article of footwear 10 may have a medial side that extends from a forefoot region 140 to a heel region 130 and a lateral side that extends from a forefoot region 140 to a heel region 130. The lateral side and the medial side may be opposite one another. In some embodiments, the lateral side and medial side may be generally parallel to one another. The lateral side may generally correspond to an outside area of a foot and a surface that faces away from a user's other foot. The medial side may generally correspond with an inside area of a foot and a surface that faces toward a user's other foot.

The upper 100 may have an interior surface 102 and an exterior surface 104. The interior surface 102 may partially define an area configured to receive a user's foot. The upper 100 may be configured to extend over a user's foot, along the medial and lateral sides of the foot, and around a forefoot region and a heel region of the foot. The area configured to receive a user's foot may be accessed from an ankle opening defined by a collar 106.

The upper 100 may be constructed from any appropriate material now known or later developed, including, but not limited to, leather, suede, fabric, canvas, weaves, knits, man-made polymer fibers, nylon, polyester, or cotton. The upper 100 may be elastic. Alternately, at least a portion of the upper 100 may be elastic. In other embodiments, the upper 100 may be inelastic. The upper 100 at least a portion that is inflexible and is rigid or semi-rigid.

The upper 100 may further include a heel counter 132 at the heel region 130. The heel counter 132 may reinforce the upper 100 and limit movement of a user's heel. The heel counter 132 may wrap around the heel region 130 and extend forward along both the lateral side and the medial side.

The sole 110 may include an outsole 112, a midsole 114, and an insole 116. The sole 110 may be coupled to the upper 100 at a bite line 105. The sole 110 may be configured to attenuate forces or provide support or cushioning. In some embodiments, the midsole 114 may be formed from a compressible material that provides cushioning. In other embodiments, the midsole 114 may comprise plates or be formed from dense materials to increase stability.

Figure 5:
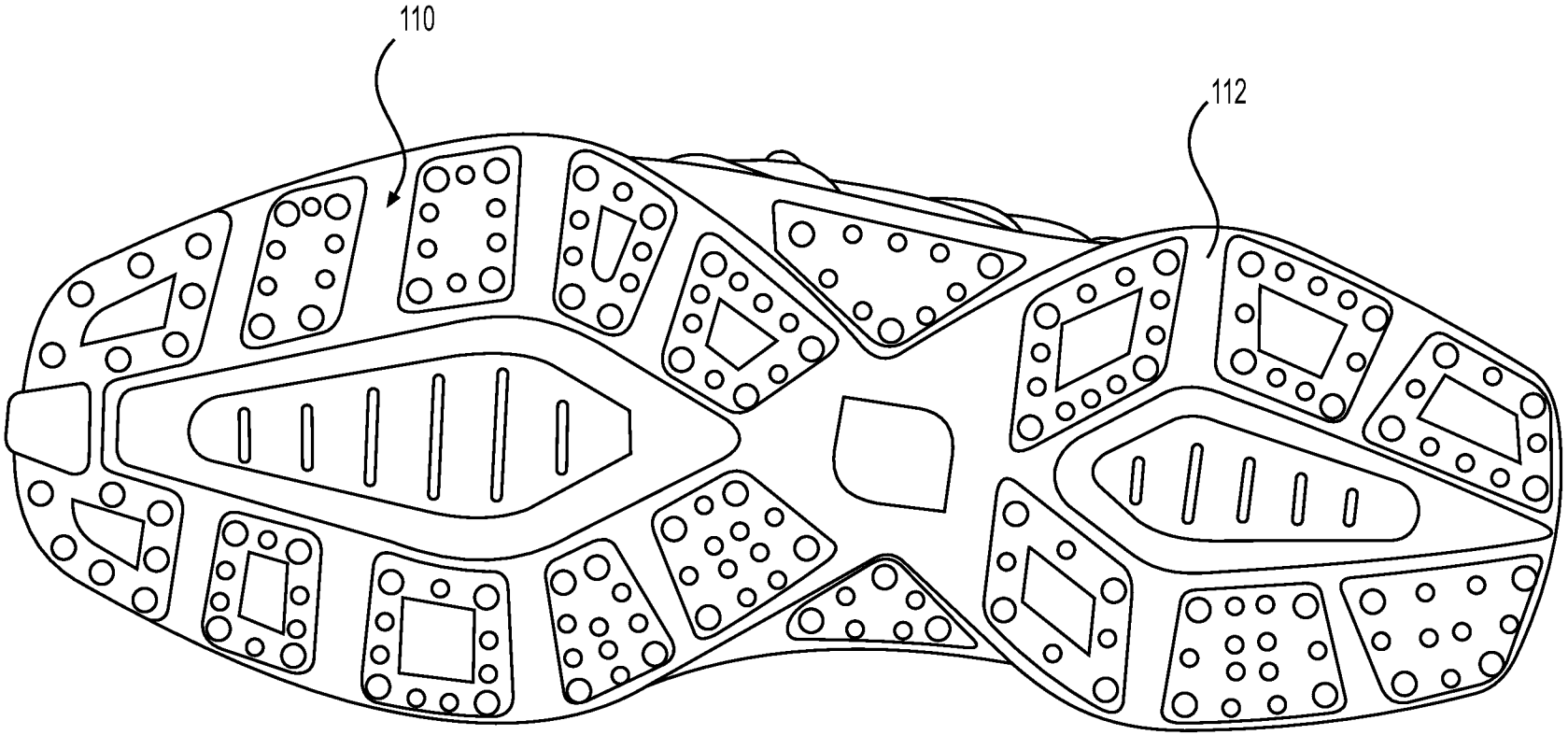
FIG. 5 is a bottom view of the article of footwear of FIG. 1 according to one embodiment.
Figure 6:
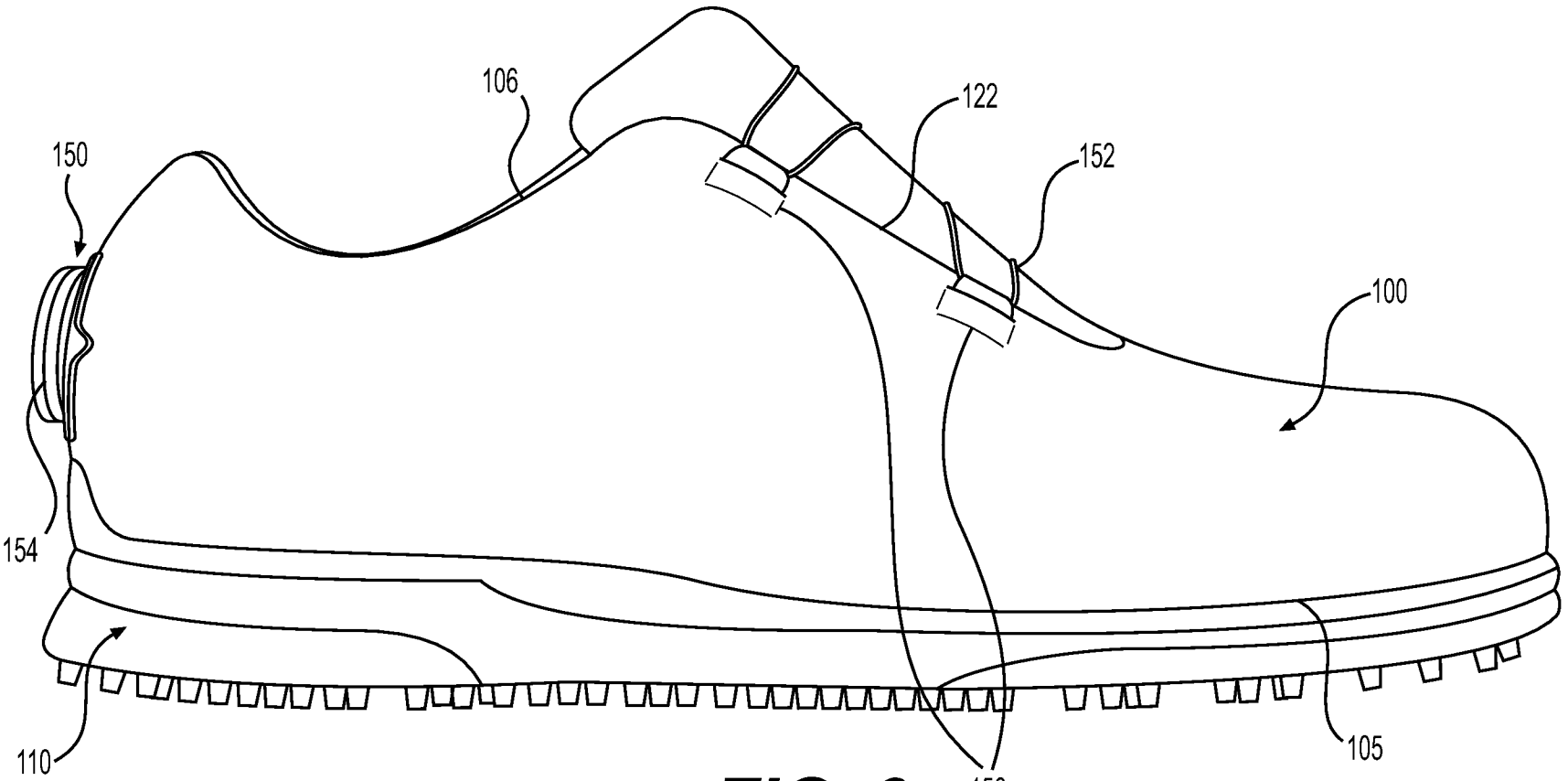
FIG. 6 is an opposite side view of the article of footwear of FIG. 1 according to one embodiment.
Figure 7:
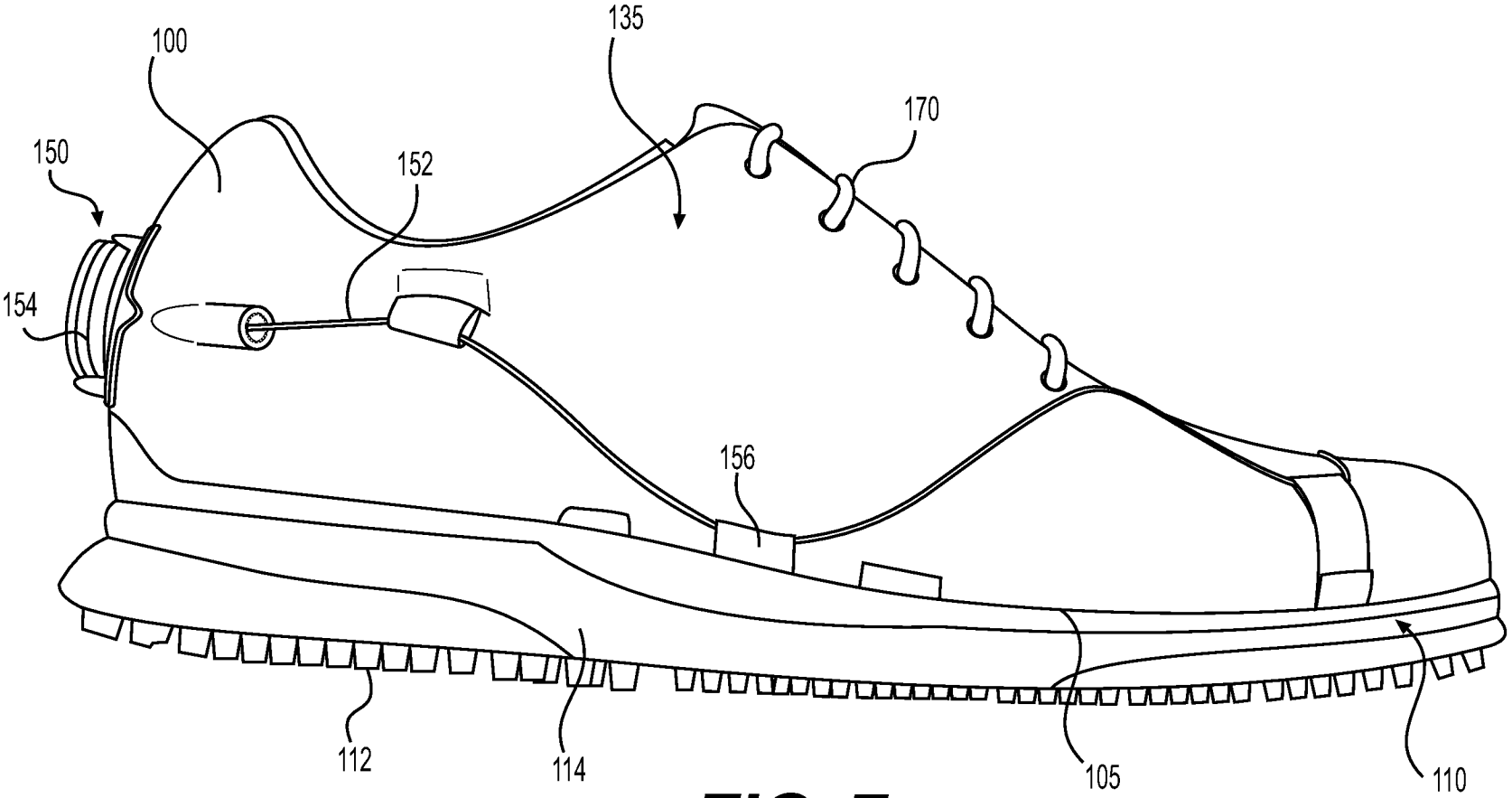
FIG. 7 is an opposite side view of the article of footwear of FIG. 1 according to another embodiment.

The outsole 112 may be below the midsole 114 and may be designed to interact with a ground surface. The outsole 112 may be designed to impart traction. In some embodiments, spikes, cleats, or other devices for additional traction may be coupled to the outsole 112. Such devices may be releasably coupled to the outsole 112. In other embodiments, such devices may be fixedly coupled to the outsole 112. In some embodiments the outsole 112 may be comprised of multiple pads or ridges, as is shown in FIG. 5.

The insole 116 may be designed to provide cushioning or comfort for a user. The insole 116 may be removable and may be above the midsole 114 when in use. In some embodiments, the insole 116 may be designed to provide support. The insole 116 may be flexible, semi-rigid, or rigid.

The article of footwear 10 may include a closure system 150. The closure system 150 may be any appropriate closure system known in the art or later developed. In one embodiment, the closure system 150 may include shoelaces for securing the upper 100 around a user's foot. In other embodiments the closure system 150 may further include at least one elastic gore so that a user can pull the upper 100 proximate a vamp 120 and the collar 106 and enlarge the ankle opening to facilitate placement of a foot within the upper 100 the article of footwear 10.

In yet other embodiments, the closure system 150 may include an adjustable lacing system that uses at least one lace 152, an adjustable dial 154, and lace guides 156. For example, the closure system 150 may be a lacing system as described in U.S. Pat No. 10,070,695 and incorporated herein by reference in its entirety. In other embodiments, the closure system 150 does not utilize an adjustable dial 154 to control the tension of the lace 152, and such tension may be increased or decreased by other means. Increasing the tension may result in a tightening of the lace 152 and decreasing the tension may result in a loosening of the lace 152. The lace 152 may be secured in any way now known or later developed. In some embodiments, the lace 152 may be secured by tying ends of the lace 152 to one another.

The lace 152 may be a tensile lace. In some embodiments, the lace 152 is a wire. When a tension of the lace 152 is increased, the lace 152 may secure the upper 100 around a user's foot. The lace 152 may be selectively adjusted using the adjustable dial 154. The tension of the lace 152 may be decreased using the adjustable dial 154 to allow a user to place its foot at least partially within the upper 100. A user may use the adjustable dial 154 to increase tension to the lace 152 in order to tighten the lace 152 and secure the upper 100 around a user's foot.

The lace guides 156 may be loops that allow the lace 152 to slide through the loop when tension is increased or decreased using the adjustable dial 154. In some embodiments, the lace guides 156 are low friction. The lace guides 156 may be coupled to the upper 100 at strategic points that enable a user to secure the upper 100 to its foot. The lace guides 156 may be strategically placed such that when tightened the lace 152 does not cause a user discomfort. The placement of the lace guides 156 may assist in stabilizing the foot. In some of the embodiments, the closure system 150 and placement of the lace guides 156 may attenuate forces acting on a user's foot such as pressure, shear force, ground forces, or the ability for flexion or movement.

As shown in FIGS. 1-4, in some embodiments the lace 152 may be above the upper 100 and configured to interact with the outer surface of the upper 104. The lace 152 may be entirely or partially visible. In other embodiments, the lace guides 156 may be placed such that the lace 152 is not in direct contact with the upper 100.

In other embodiments, the lace 152 may be between an exterior surface of the upper 104 and an interior surface of the upper 102. In such embodiments there may be a channel for the laces between the exterior surface of the upper 104 and the interior surface of the upper 102. The lace guides 156 may also be positioned between the exterior surface of the upper 104 and the interior surface of the upper 102.

In some embodiments, a portion of the lace 152 may be between an exterior surface of the upper 104 and an interior surface of the upper 102, and a portion of the lace 152 may be above an exterior surface of the upper 104.

In embodiments where at least a portion of the lace 152 is above an exterior surface of the upper 104, the upper 100 may optionally have grooves (not shown herein) for facilitating the placement of the lace 152 when the adjustable dial 154 is tightened. The grooves may secure the lace 152 when the adjustable dial 154 is tightened and prevent the lace 152 from slipping or being tightened at an undesired location that may affect forces acting on the article of footwear or a user's foot. The grooves may also provide a reliable position for the lace 152 such that a user would not need to readjust the lace 152.

Figure 10:
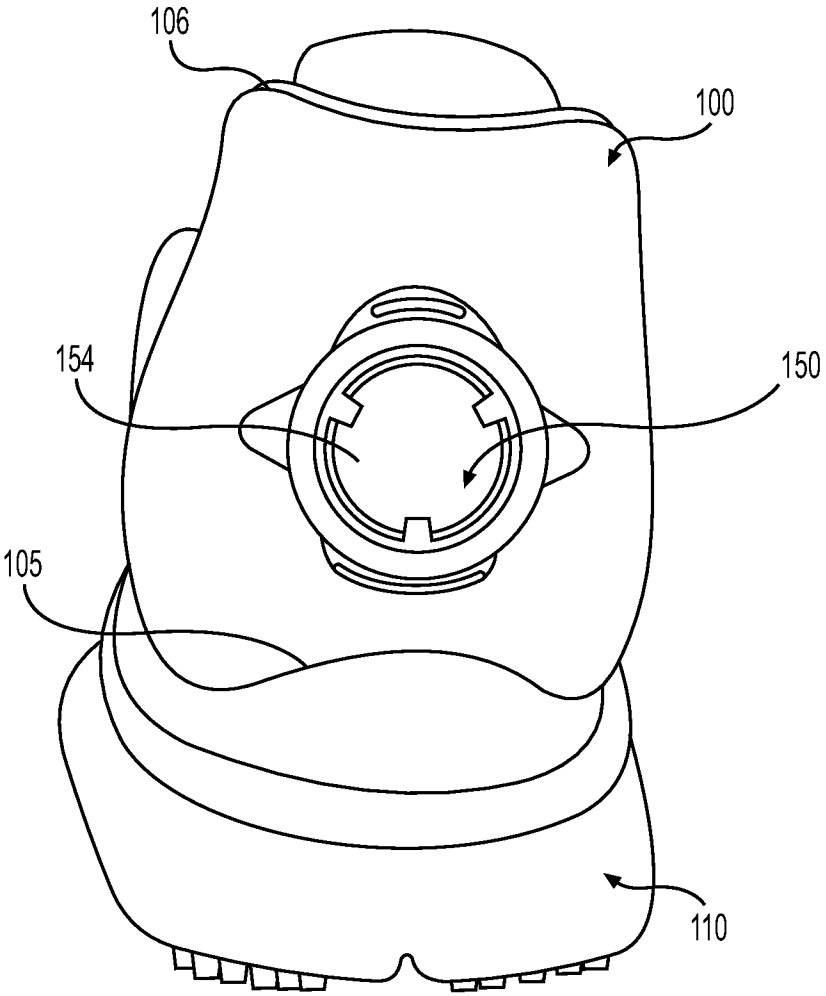
FIG. 10 is a rear view of the article of footwear of FIG. 1 according to one embodiment.

As shown in FIG. 10, the adjustable dial 154 may be at a rear of the article of footwear 10 at the heel region 130. In some embodiments, the adjustable dial may be generally halfway between the collar 106 and the bite line 105. The placement of the adjustable dial 154 at the rear of the article of footwear 10 may be beneficial due to the forces exerted when adjusting the tension of the lace 152. Placement of the adjustable dial 154 at the heel region 130 may provide increased stability of the article of footwear 10.

The placement of the adjustable dial 154 may provide increased stability when downward pressure is applied to the sole 110. The placement of the adjustable dial 154 may also increase freedom of movement when the downward pressure is lifted. The strategic placement of the lace guides 156 may provide increased stability when downward pressure is applied to the sole 110 and increased freedom of movement when the downward pressure is lifted. In some embodiments, the lace 152 may be crossed in an X pattern proximate the forefoot region. The X pattern configuration may provide greater mechanical advantage. In some embodiments, the combination of the adjustable dial 154 at the heel region 130 and the strategic placement of the lace guides 156 may provide increased stability when downward pressure is applied to the sole and increased freedom of movement when the downward pressure is lifted and/or a forefoot region 140 is flexed. The flexion in the forefoot region 140 may be a dorsal flexion.

The lifting of the downward pressure may introduce slack into the lace 152 when there is flexion in the forefoot region 140. In some embodiments, slack may be introduced without the need to further adjust the tension of the closure system 150. The tension may thus be automatically adjusted using the lacing configuration such that slack is introduced when there is flexion in the forefoot region 140 and the lace 152 is pulled taut when downward pressure is applied to the sole 110. Downward pressure applied to the sole 110, such as when a user plants its foot, may increase the tightness of the laces 152 and thereby further stabilize the article of footwear 10. The taut laces 152 may engage a flap 160 as further described below, thereby adding stability for a lateral load. This may result in an article of footwear 10 that has increased stability when a user's foot is planted, and increased freedom of motion when the downward pressure is lifted and the forefoot is flexed. Such an article of footwear 10 may be comfortable for a user to walk in or engage in other ambulatory activities, while still providing increased stability when a user's foot is planted.

In some embodiments, the adjustable dial 154 may be coupled to the upper 100 proximate an eyestay 122. In other embodiments, the adjustable dial may be coupled to the upper 100 at a quarter of the article of footwear 10.

Figure 8:
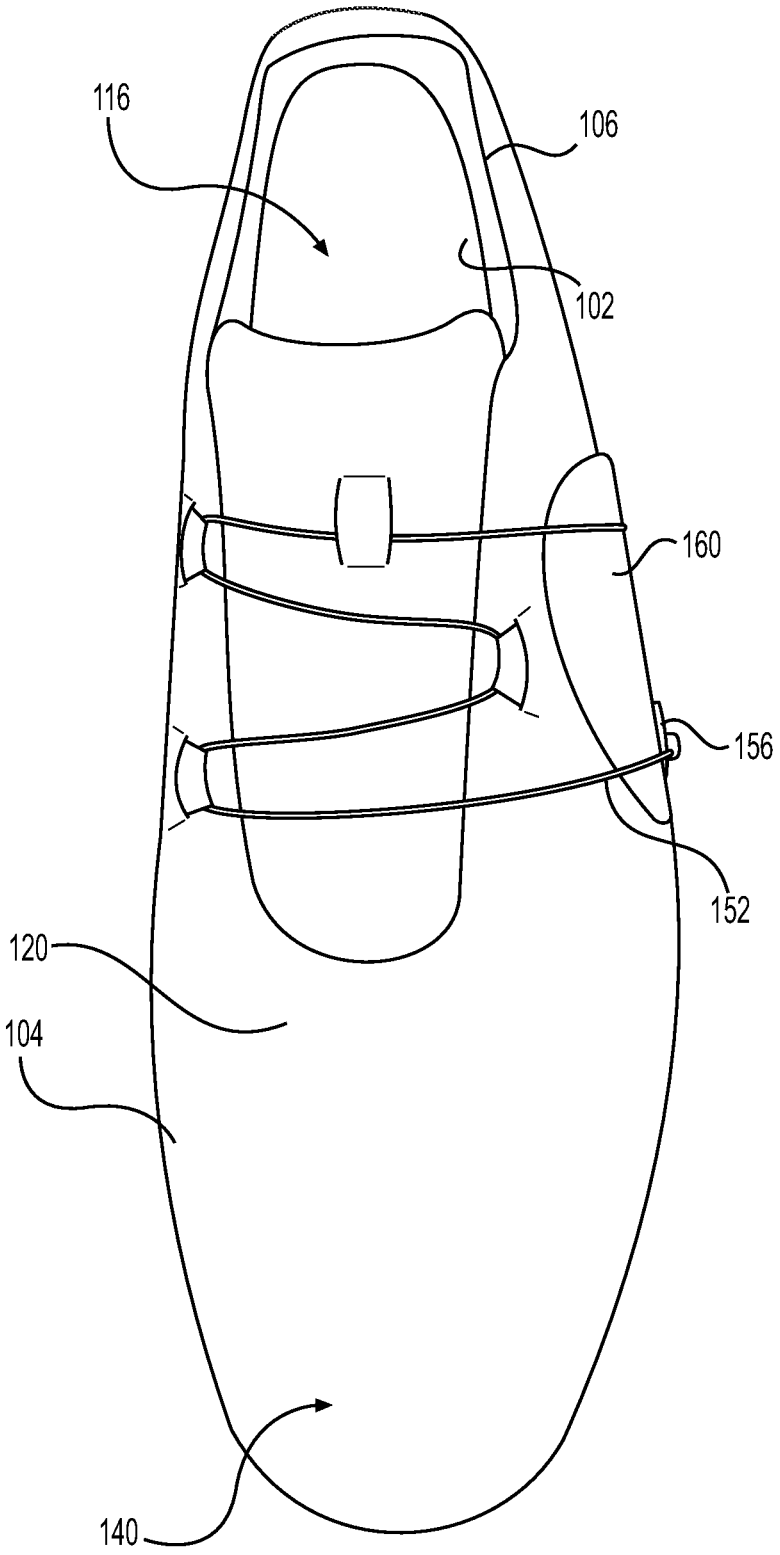
FIG. 8 is a top perspective view of the article of footwear of FIG. 1 according to one embodiment.
Figure 9:
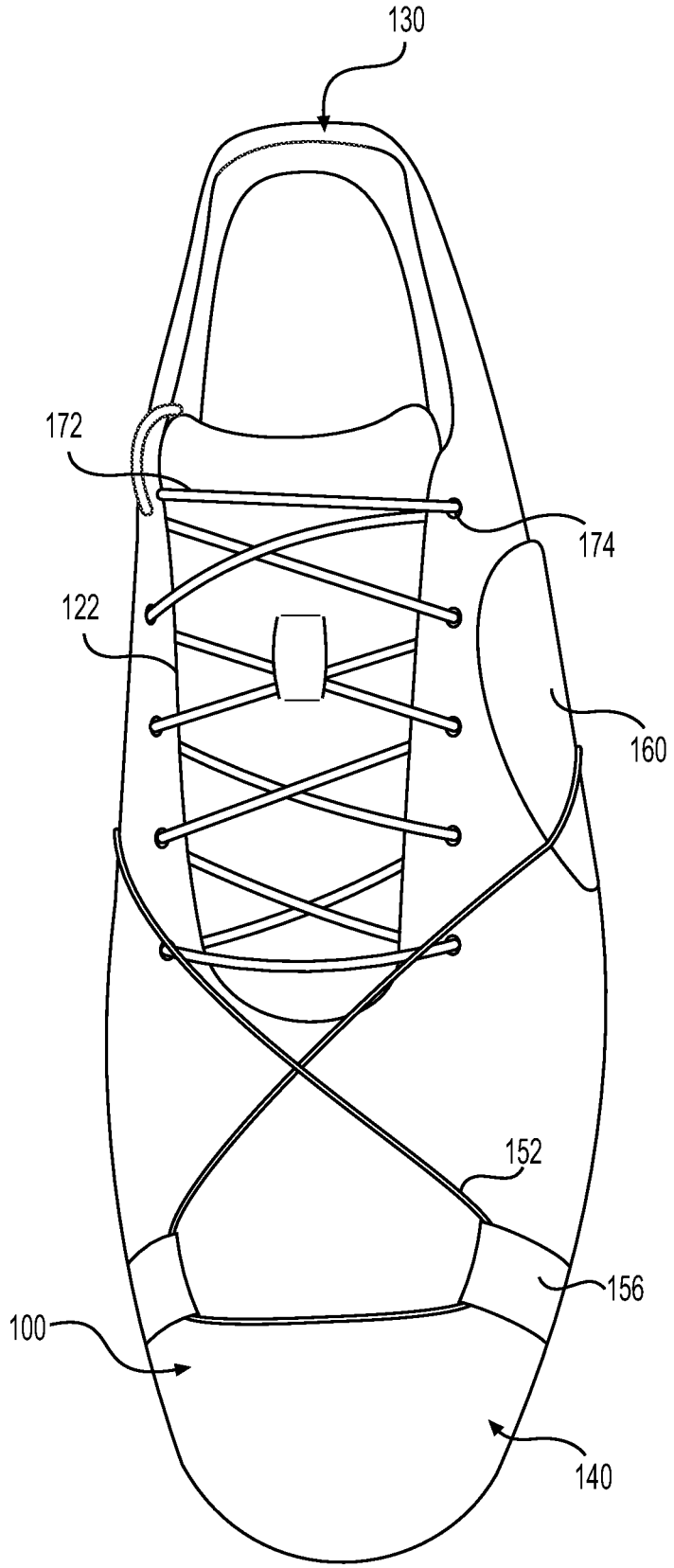
FIG. 9 is a top perspective view of the article of footwear of FIG. 1 according to another embodiment.

In some embodiments, and as is shown in FIG. 8, at least one lace guide 156 may be placed proximate the eyestay 122. In some embodiments, two lace guides 156 may be placed proximate a medial eyestay and one lace guide 156 may be placed proximate a lateral eyestay.

The lace 152 may be coupled at a first end to the adjustable dial 154 and at a second end to a lace anchor 158. The lace anchor 158 may be coupled to the article of footwear 10 proximate the bite line 105. In some embodiments, the lace anchor 158 is fixedly coupled to the article of footwear 10. In some embodiments, the lace guides 156 may be coupled at the bite line 105 adjacent the flap 160. In some embodiments, the lace guides 156 and/or lace anchor 158 may be coupled anywhere to the flap 160. For example, the lace guides 156 and lace anchor 158 may be coupled to the flap 160 at an upper, middle or lower region of the flap. The positions of the lace guides 156 and lace anchor 158 are independent from one another and need not be in the same region.

The article of footwear 10 may include at least one flap 160. In some embodiments, each shoe in a pair of shoes may have a flap 160. The flap 160 may provide a benefit for the user by further stabilizing at least a portion of the footwear 10 to reduce the effects of shear forces during wear. When engaged, the flap 160 produces a cinching action that stabilizes a region of the footwear 10 and distributes the applied pressure over a desired area of the footwear.

The flap 160 may be rigid or semi-rigid. The amount of stabilization provided by the flap 160 may vary depending on its rigidity, wherein increased rigidity may provide higher stabilization effects. In some embodiments, the flap 160 may have a non-uniform rigidity. For example, the flap 160 may have regions of increased rigidity, such as the region at and near the bite line. In some embodiments, the flap may have a rigidity gradient, wherein the most rigid point is near the bite line and the least rigid point is at the uppermost point 162. Rigidity may be varied by increasing the thickness of the material (e.g., applying additional layers of material) at areas where increased rigidity is desired. In some embodiments, the flap 160 may be flexible.

The flap 160 may be formed from leather, fabric, carbon fiber, thermosets, thermoplastics, or any appropriate material now known or later developed with suitable rigidity. In some embodiments, the flap 160 comprises a self-reinforced polymer composite material. Self-reinforced polymer composites are generally known in the composite industry and refer to fiber-reinforced composites comprising reinforcing fibers and a polymer matrix, where the highly oriented reinforcing fibers are made from the same polymer in which the matrix is made. For example, a polypropylene matrix can be reinforced with polypropylene fibers. Different thermoplastic polymers can be used including, for example, polypropylene, polyethylene terephthalate, polymethyl methacrylate, liquid crystal polymers, polylactic acid, and polyamides. Self-reinforced polymer composites are commercially available and sold, for example, under the trademarks of Pure® (DIT BV and Milliken USA (formerly Lankhorst Pure Composites, The Netherlands); Armordon® (Don & Low, Ltd., Scotland, UK); and Curv® (Propex Furnishing Solutions GmbH&Co. KG (Gronau, Germany).

Self-reinforced composites can be made using various technologies including hot compaction and co-extrusion methods. In general, hot-compaction refers to a method by which highly oriented polymer tapes are heated. The heating allows a small percentage of the polymer tapes to melt.

When pressure is applied, this molten polymer flows through the lattice work of the tapes to form a continuous matrix. The sheet is then cooled while still under pressure to solidify the matrix. The fiber-drawing process provides higher stiffness as the surface facings of the fibers are melted. The melted skin is re-crystallized to form the polymer matrix and a highly stiff, smooth composite sheet is produced. This rigid sheet can then be thermoformed into a flap constructed according to one or more embodiments as described herein.

In a co-extrusion process, a high melting point grade of the polymer is used to extrude highly oriented polymer tapes. During this process, a low-melting point grade of the same polymer family is extruded on the surface of the tape. These tapes can then be woven to form a fabric. During post-processing into shaped parts and articles, the outer layer of the tape melts before the inner core of the oriented polymer. Under pressure, the low melt grade polymer flows throughout the fabric. On cooling, this low melt grade polymer re-solidifies to form the composite matrix and a composite sheet is produced.

These self-reinforced composites are lightweight and have high strength. Other advantageous properties include, for example, a high stiffness, high tensile strength, and outstanding impact resistance. Because the reinforcement fibers and matrix are made of the same polymer, they are chemically compatible and there is low interfacial failure.

In particular, these self-reinforced composites have low density, preferably less than about 1.0 g/cm3 and more preferably less than 0.95 g/cm3 (as measured according to ISO1183). The combination of highly oriented tapes and matrix made of the same polymer helps provide a light-weight material with good physical properties such as strength, toughness, and modulus.

The composites also have high impact strength. The Charpy Impact strength is greater than 90 $kJ/m^2$, more preferably greater than 100 $kJ/m^2$, and even more preferably greater than 110 $kJ/m^2$ (as measured according to EN ISO 179/2). The Tensile Strain to Failure (as measured according to DIN EN ISO 527) is preferably at least 10%. The Compression strength (flat wise) (as measured according to EN ISO 604) is preferably greater than 200 MPa and more preferably greater than 250 MPa.

The composites are ductile material that stay ductile at low temperatures. That is, these composites maintain their toughness and do not become brittle at cold temperatures. Furthermore, these composites can be recycled easily since the reinforcing material is made of the same polymer as the polymer matrix. The composites are made entirely of thermoplastic so the component part can be broken down, re-melted and then re-granulated so that it can be used to make new components.

These self-reinforced polymer composite materials and methods of manufacturing are described in the patent literature including, for example, Ward et al., U.S. Pat. Nos. 9,873,239; 8,871,333; 8,268,439; 8,052,913; and 8,021,592 (Propex) and Loos et al., U.S. Pat. No. 7,318,961 (Lankhurst); and Nair et al., U.S. Pat. No. 7,960,024 and Callaway, U.S. Pat. No. 7,300,691 (Milliken).

The polypropylene self-reinforced composite, Curv®, available from (Propex Furnishing Solutions GmbH&Co. KG (Gronau, Germany) is a particularly preferred material. The Curv® composite material is based on highly drawn tapes made of polypropylene homopolymer. During a precisely controlled heating process, the polypropylene tapes are heated so that only a thin outer layer of the tapes is melted. The outer melted material bonds the tapes together while the tapes maintain their orientation through most of their thickness. The Curv® composite material can be molded to form the base using a thermoforming process. The Curv® composite material has a relatively high stiffness even at molding temperatures so moderate pressure is needed to shape the material. In one process, a sheet of Curv® composite material is heated to a moderate temperature, where the shrinkage of the sheet is kept low. The Curv® composite material is molded by moderate pressure compression molding. Because of the Curv® composite material's high stiffness, vacuum thermoforming is not used.

The flap 160 may be any shape. As is shown in FIGS. 1-4, the flap 160 may have a substantially semi-circular shape. It is contemplated that the flap 160 may be substantially semi-circular, triangular, ovular, or rectangular. In some embodiments, it is anticipated that the flap 160 may have an irregular shape. The flap 160 may have rounded edges or sharp edges. The flap 160 may have an uppermost point 162, a heel end 164, and a forefoot end 166. In some embodiments the flap 160 is entirely within the midfoot region 135. In other embodiments the heel end 164 may extend into the heel region 130 or the forefoot end 166 may extend into the forefoot region 140. In other embodiments, the forefoot end 166 is generally posterior to a forefoot flexion area. The flap 160 may have a width that is generally uniform throughout the flap. Alternately, the flap 160 may have a variable width to provide increased stability. In some embodiments, the width of the flap 160 may be thicker proximate the bite line 105 and taper as it extends toward an uppermost point 162. The flap 160 may have grooves to facilitate proper placement of the laces 152.

The flap 160 may be configured to provide lateral support when downward pressure is applied to the sole 110. The closure system 150 may engage the flap 160 by pushing or pulling the flap 160 toward a center of an article of footwear 10. If the flap 160 is coupled on the medial side, the closure system 150 may push or pull the flap 160 inwardly toward the lateral side. If the flap 160 is coupled on the lateral side, the closure system 150 may push or pull the flap inwardly toward the medial side. Engaging the flap 160 prevents the upper 100 from twisting around the user's foot and the foot from linearly sliding medio-laterally within the footwear 10.

The flap 160 may provide stability for various types of biomechanical movements. For example, the biomechanics associated with swinging a golf club call for a rapid shift of weight from back foot to front foot. Shear forces are applied to both feet through the swing. During the backswing, the back foot must remain stable. Improperly shifting weight at the back foot may result in improper contact with the ball. Further, due to biomechanics, the back foot may be susceptible to being rolled to the lateral outside or slipping from the initial foot placement. Weight transfer may thus be diminished and rotation may be lost. On the downswing, weight is shifted to the front foot, which must now remain relatively stable. Increasing foot stability may result in increasing the efficacy and quality of a golf swing.

When the flaps 160 of a pair of shoes are engaged, the feet remain further secured within their respective shoe and are prevented from shifting while swinging the golf club. Thus, the feet are also more easily planted in position when the flap 160 is engaged. During a backswing, the flap 160 stabilizes the trail foot by reducing abduction and external rotation. Reducing abduction and external rotation of the back foot enables the user to place more load on the back hip leg muscle thereby enabling increased separation between the hips and shoulders prior to the downswing.

It is contemplated that the flap 160 may stabilize a desired portion of the foot for a variety of activities, and there is no intention to limit the usefulness of the current disclosure. For example, the flap 160 may stabilize at least a portion of a medial midfoot region.

Figure 11:
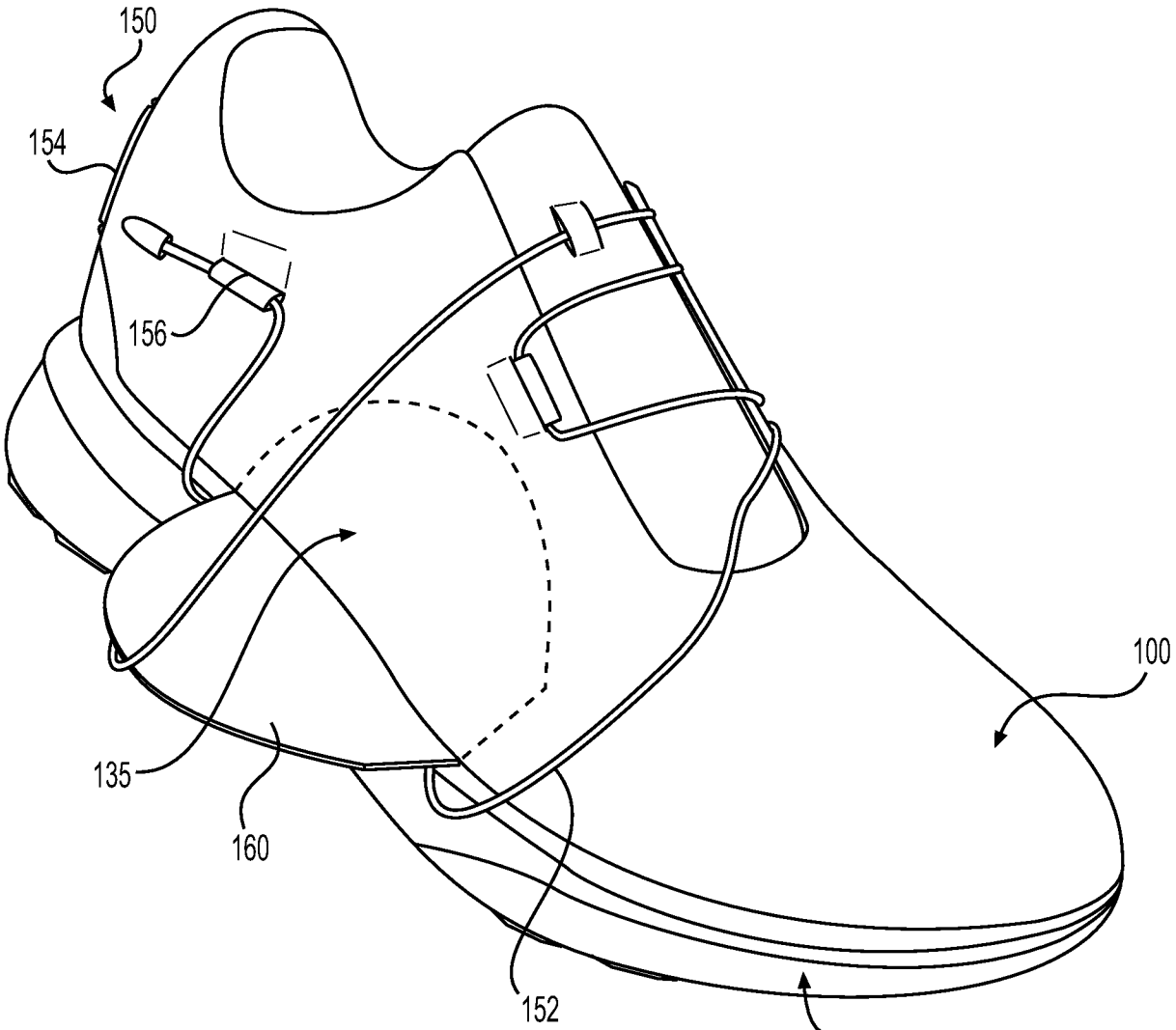
FIG. 11 is a perspective partially exploded view of the article of footwear of FIG. 1 according to one embodiment.

As is shown in FIG. 11, the flap 160 may be coupled to the article of footwear 10 at the bite line 105. In these embodiments, the flap 160 reduces the effect of medio-lateral shear forces generated between a footwear traction system and a substratum when worn by a user by adding lateral rigidity to the bite line area when the flap 160 is engaged. In some embodiments, the flap 160 may be coupled to the upper 100. In some embodiments, the flap 160 is configured to be coupled to a lateral side of a back foot as described above. In some embodiments the lace 152 may overlay the flap 160.

The flap 160 may be unattached to the upper 100. In some embodiments when the flap 160 is only attached at the bite line 105 an attachment point may be a hinged connection and the flap 160 may be able to partially rotate outwardly and downwardly. In other embodiments, a hinged connection may not be necessary as the coupling of the flap 160 to the bite line 105 may allow the flap 160 may to partially rotate outwardly and downwardly about the bite line 105, as is shown in FIG. 11. Yet, in alternative embodiments, the flap 160 may be attached near the upper 100 using various means known in the art including sewing or adhering. For example, the flap 160 may be a rigid layer wrapped around the upper 100 wherein the uppermost point 162 of the upper is still free to be pulled across the upper 100.

The flap 160 may be variable between two general positions. The flap 160 may have a relaxed position in which the flap is not tightly held or pulled to the upper 100, which is shown in FIG. 11. The flap 160 may be in the relaxed position when a downward pressure is released from the sole 110, when there is a flexion in a forefoot region 140, or when the closure system 150 is not tightened. The flap 160 may also have an engaged position wherein the flap 160 is not secured to the upper.

In the relaxed position, a portion of the flap 160 may not be in contact with the upper 100. The flap 160 may be configured to slide against the upper 100 as opposed to applying continuous support. In some embodiments, the closure system 150 crosses over the flap 160. When the lace 152 of the closure system is tightened, the flap 160 may be held tight and secured to the upper 100 in the engaged position. This may provide increased lateral stability. However, if the flap 160 was to always provide the increased stability, the article of footwear 10 may be rendered rigid and uncomfortable. It may be painful to engage in prolonged ambulatory movement with the flap 160 in the engaged position. Therefore, when the lace 152 is slack, the flap 160 may arc laterally outward from the upper 100. The release of the flap 160 may provide increased comfort and improve the flexibility of the article of footwear 10.

In some embodiments, there may be a secondary closure system 170 proximate the vamp 120 as can be seen in FIGS. 2, 4, 7, and 9. The secondary closure system may include shoelaces 172 and a tongue 174. There may be eyelets 176 in an eyerow proximate the eyestay configured to receive the shoelaces 172. The shoelaces 172 may be inelastic or resiliently elastic. The shoelaces 172 may have a first end and a second end, and each end may further have an aglet. The shoelaces 172 may be threaded through the eyelets 176 such that when pulled taut, the upper 100 and tongue 174 secure a user's foot within the upper 100.

It will be appreciated that the secondary closure system may also include a variety of fastening mechanisms, such as bands with hook and loop closures, buckles, buttons, hooks, snaps, or any other fastening device now known or later developed.

The article of footwear 10 may have three general embodiments offering varying levels of stability and ease of use. The first embodiment may relate to an article of footwear 10 having a flap 160 and a closure system 150. The first embodiment may also have a secondary closure system 170. The flap 160 may be coupled to the article of footwear 10 at the bite line 105 but is otherwise moveable and configured to be adjustably tightened to the upper 100 using the closure system 150. There may be at least one lace guide 156 proximate the bite line 105 at the midfoot region 135. There may also be at least one lace guide 156 in the forefoot region 140. The lace guide 156 in the forefoot region may be proximate the bite line 105 or may be above the bite line 105 and on the outer surface of the upper 104. The laces may be hidden by view by the use of a fabric tubing channel or other means. In some embodiments, the lace 152 may cross in an X pattern at the vamp 120 in the forefoot region 140. Alternately, the lace 152 may be crossed in an X pattern in the midfoot region 135. This may provide increased stability, strength, and tension due to the length of the closure system from the forefoot region 140 to the heel region 130.

A lateral load of a foot may be relatively low proximate the bite line 105. The lace guides 156 may be coupled at or proximate the bite line 105. A lacing configuration employing lace guides 156 proximate the bite line 105 reduces excess pressure at the vamp 120 and the midfoot region 135. In contrast, typical closure systems, such as shoelaces and eyelets, apply excess downward pressure resulting in lace bite. If the lateral load is stabilized above the bite line 105, a foot may still roll or be misplaced. Thus, if the lateral load is stabilized at the bite line 105, it provides increased stability. The lateral load is stabilized at the bite line 105 when the flap 160 is in the engaged position. In some embodiments, the lace guides 156 and/or lace anchor 158 may be coupled to other areas of the flap 160. For example, the lace guides 156 and/or lace anchor 158 may be coupled to the top of the flap 160 to place the flap 160 in tension along the inferior/superior length of the article of footwear 10. In these embodiments, the flap 160 preferably still remains pivotably attached to the bite line 105.

The X pattern may further promote the increase and decrease in a tension of the lace 152. The lace 152 may be tightened when a downward force is applied to the sole 110. The tightened lace 152 may secure the flap 160 proximate the upper 100. The tension in the lace 152 may thus be activated automatically. When there is flexion in the forefoot region 140, the article of footwear 10 may be move such that slack may be introduced to the lace 152. The slack lace 152 may permit the flap 160 to transition from an engaged position to a relaxed position.

The second embodiment may relate to an article of footwear 10 having a flap 160 and a closure system 150. The closure system 150 may be more similar to a typical shoelace system and at least one lace guide 156 may be proximate the eyestay 122. The tension in the laces 152 may be activated automatically, but the article of footwear 10 may have a decrease in stability when compared to the lacing configuration employing the X pattern due to a lacing configuration that may not as tightly secure the flap 160 to the upper 100.

The third embodiment may relate to an article of footwear 10 having a flap 160, a closure system 150, and a secondary closure system 170. The secondary closure system 170 may act as the primary closure system, and the closure system 150 may be designed to be adjusted and tightened such that the flap 160 provides increased stability before an increased stability is desired. For example, in use, a user may manually increase the tension before swinging a golf ball to increase lateral foot support. The article of footwear 10 may otherwise be secured, but the closure system 150 may activate the flap 160. Once the increased stability is no longer desired, the closure system 150 may be adjusted to decrease the tension of the laces 152 such that the flap 160 may not be tightened to the upper. For example, upon completing a golf swing and anticipating walking to the next shot, a user may decrease the tension before beginning to walk. In some embodiments, slack in the laces 152 may not be automatically transferred upon release of a downward pressure on the sole 110. Therefore, the closure system 150 may need to be adjusted each time increased or decreased stability from the flap 160 is desired.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims.

It is claimed:

1. An article of footwear comprising:

a flexible upper;

a sole having an outsole and a midsole;

a bite line;

a heel region, a midfoot region, and a forefoot region;

a medial side extending from the forefoot region to the heel region;

a lateral side extending from the forefoot region to the heel region and opposite to and generally parallel the medial side;

a single flap positioned entirely in the midfoot region on the lateral side of the article of footwear, wherein the flap is moveable in an arc between a relaxed position and an engaged position, wherein the flap has a rigidity gradient and a most rigid point at or near a lower region of the flap and a least rigid point at or near an uppermost region of the flap, wherein a thickness of the flap increases from the uppermost region of the flap to the lower region of the flap to provide the rigidity gradient; and a closure system that secures the flap to the upper, wherein a tension of the closure system is adjustable, wherein the closure system is configured to cross over the flap and engage a lace guide and a lace anchor provided on the lower region of the flap, wherein the closure system (i) secures the flap to the upper to stabilize at least a portion of the upper against a shear force when the tension of the closure system increases and (ii) releases a forefoot end of the flap when the tension of the closure system decreases so that the flap arcs outwards and away from the upper as slack is introduced to the closure system, wherein the closure system comprises a lace with a first end coupled to an adjustable dial positioned in the heel region and a second end that is fixedly coupled to the lace anchor provided on the lower region of the flap.

2. The article of footwear of claim 1, wherein the flap extends outwardly from the bite line.

3. The article of footwear of claim 2, wherein the flap is configured to rotate about the bite line.

4. The article of footwear of claim 1, wherein when the lace is taut, the flap is in the engaged position to provide lateral support to the midfoot region of the article of footwear.

5. The article of footwear of claim 1, wherein the tension of the closure system increases when a downward pressure is applied to the sole, and wherein slack is introduced to the closure system when the downward pressure is lifted and there is flexion in the forefoot region.

6. The article of footwear of claim 1, wherein the flap has a thickness that varies between an upper portion of the flap and a lower portion of the flap.

7. The article of footwear of claim 1, wherein the flap has a variable width that tapers towards an upper portion of the flap.

8. The article of footwear of claim 1, wherein the flap includes one or more grooves to facilitate placement or movement of at least one lace of the closure system.

9. The article of footwear of claim 1, wherein the flap is configured to rotate outwardly and downwardly about a hinged connection at the bite line.

10. The article of footwear of claim 1, wherein the flap extends horizontally outwards from the upper when placed in or moved towards the relaxed position.

11. The article of footwear of claim 10, wherein the closure system remains attached or coupled to the flap when the flap extends horizontally outwards from the upper.

12. The article of footwear of claim 1, wherein the lace is configured to disengage and separate from the forefoot end of the flap in order to release the flap.

13. The article of footwear of claim 1, wherein the flap comprises a self-reinforced polymer composite material or a carbon fiber material, and wherein the flap has a semicircular shape with a rounded edge portion and a sharp edge portion extending along the forefoot end of the flap.

14. An article of footwear comprising:

a flexible upper;

a sole having an outsole and a midsole;

a bite line;

a heel region, a midfoot region, and a forefoot region;

a medial side extending from the forefoot region to the heel region;

a lateral side extending from the forefoot region to the heel region and opposite to and generally parallel the medial side;

a single flap positioned entirely in the midfoot region on the lateral side of the article of footwear, wherein the flap is moveable in an arc between a relaxed position and an engaged position, wherein the flap has a rigidity gradient and a thickness that increases from an uppermost region of the flap to a lower region of the flap to provide the rigidity gradient, wherein the flap has a most rigid point at or near the lower region of the flap and a least rigid point at or near the uppermost region of the flap; and a closure system, wherein the closure system is configured to cross over the flap and engage at least one lace guide and a lace anchor provided on the lower region of the flap, wherein the closure system (i) secures the flap to the upper to stabilize at least a portion of the upper against a shear force when a tension of the closure system increases and (ii) releases a forefoot end of the flap when the tension of the closure system decreases so that the flap arcs outwards and away from the upper as slack is introduced to the closure system, wherein the closure system comprises at least one lace comprising a first end coupled to an adjustable dial positioned in the heel region and a second end that is fixedly coupled to the lace anchor provided on the lower region of the flap.

15. The article of footwear of claim 14, wherein the at least one lace guide comprises two lace guides at the forefoot region, and wherein the at least one lace crosses over the upper in an X pattern.

16. The article of footwear of claim 15, wherein the at least one lace is pulled taut when a downward pressure is applied, and wherein slack is introduced to the at least one lace when the downward pressure is lifted and there is flexion in the forefoot region.

17. An article of footwear comprising:

a flexible upper;

a sole having an outsole and a midsole;

a bite line;

a heel region, a midfoot region, and a forefoot region;

a medial side extending from the forefoot region to the heel region;

a lateral side extending from the forefoot region to the heel region and opposite to and generally parallel the medial side;

a single flap positioned entirely in the midfoot region on the lateral side of the article of footwear, the flap having a forefoot end, a heel end, and an uppermost point, the flap coupled to the article of footwear proximate the bite line, wherein the flap is moveable along an arc between an engaged position and a relaxed position, wherein in the engaged position the flap provides lateral support to the midfoot region of the article of footwear, wherein the flap has a rigidity gradient with a most rigid point at or near a lower region of the flap and a least rigid point at or near an uppermost region of the flap, wherein a thickness of the flap increases from the uppermost region of the flap to the lower region of the flap to provide the rigidity gradient; and an adjustable closure system, wherein the closure system is configured to cross over the flap and engage a lace guide and a lace anchor provided on the lower region of the flap, wherein the closure system (i) secures the flap to the upper to stabilize at least a portion of the upper against a shear force when a tension of the closure system increases and (ii) releases the forefoot end of the flap when the tension of the closure system decreases so that the flap arcs outwards and away from the upper as slack is introduced to the closure system, wherein the closure system comprises a lace with a first end coupled to an adjustable dial positioned in the heel region and a second end that is fixedly coupled to the lace anchor provided on the lower region of the flap.

18. The article of footwear of claim 17, wherein the lace is crossed over itself at the upper.

* * * * *